US010689156B2

(12) United States Patent
Sawachi

(10) Patent No.: US 10,689,156 B2
(45) Date of Patent: Jun. 23, 2020

(54) FOLDABLE TOTE BOX

(71) Applicant: ECOBIZ CO., LTD., Osaka-shi, Osaka (JP)

(72) Inventor: Katsuaki Sawachi, Osaka (JP)

(73) Assignee: ECOBIZ CO., LTD., Osaka-shi, Osaka (JP)

( * ) Notice: Subject to any disclaimer, the term of this patent is extended or adjusted under 35 U.S.C. 154(b) by 0 days.

(21) Appl. No.: 16/080,925

(22) PCT Filed: Feb. 1, 2017

(86) PCT No.: PCT/JP2017/003574
§ 371 (c)(1),
(2) Date: Aug. 29, 2018

(87) PCT Pub. No.: WO2017/150057
PCT Pub. Date: Sep. 8, 2017

(65) Prior Publication Data

US 2019/0092525 A1 Mar. 28, 2019

(30) Foreign Application Priority Data

Mar. 4, 2016 (JP) ..... 2016-042034

(51) Int. Cl.
*B65D 21/08* (2006.01)
*B65D 25/54* (2006.01)
(Continued)

(52) U.S. Cl.
CPC ..... *B65D 21/086* (2013.01); *A45C 7/0036* (2013.01); *A45C 13/002* (2013.01);
(Continued)

(58) Field of Classification Search
CPC ..... B65D 81/38; B65D 11/18; B65D 11/20; B65D 21/086; B65D 21/0217;
(Continued)

(56) References Cited

U.S. PATENT DOCUMENTS 2,016,520 A * 10/1935 Short ..... A45C 7/0077 206/289
2,290,681 A * 7/1942 Fussner ..... B65D 5/4204 206/732
(Continued)

FOREIGN PATENT DOCUMENTS

GB 1470583 A * 4/1977 ..... B65D 11/10
JP 10-147337 A 6/1998
(Continued)

OTHER PUBLICATIONS

International Search Report for corresponding International Application No. PCT/JP2017/003574 dated Mar. 7, 2017.
(Continued)

*Primary Examiner* — Robert J Hicks
(74) *Attorney, Agent, or Firm* — Renner, Otto, Boisselle & Sklar, LLP

(57) ABSTRACT

A foldable tote box enables a content thereof to be visually checked under a state in which a lid is closed. The foldable tote box includes a box body including: a square or rectangular bottom surface part; front and rear side wall parts and right and left side wall parts corresponding to respective sides; a lid extending from an upper edge of the rear side wall part; and a reinforcement plate configured to reinforce the bottom surface part. The reinforcement plate is pivotably mounted on a lower edge of the front side wall part or the rear side wall part. The right and left side wall parts are inwardly foldable when a center portion of the bottom surface part is pulled up. Each of the side wall parts is formed of a frame member, and a sheet material including a transparent portion is supported by the frame member.

4 Claims, 5 Drawing Sheets

(51) Int. Cl.

| | |
|---|---|
| ***B65D 25/28*** | (2006.01) |
| ***A45C 13/00*** | (2006.01) |
| ***B65D 21/02*** | (2006.01) |
| ***A45C 7/00*** | (2006.01) |
| ***B65D 37/00*** | (2006.01) |

(52) U.S. Cl.
CPC ..... *B65D 21/0217* (2013.01); *B65D 25/2841* (2013.01); *B65D 25/2852* (2013.01); *B65D 25/54* (2013.01); *B65D 37/00* (2013.01)

(58) Field of Classification Search
CPC ..... B65D 25/2841; B65D 25/2838; B65D 25/2852; B65D 25/54; B65D 37/00; B65D 11/1813; B65D 11/1806; B65D 11/184; A45C 7/0036; A45C 7/0018; A45C 7/0077; A45C 13/002
USPC ..... 220/9.2, 9.3, 9.1, 592.26, 592.2, 754, 220/602, 662, 666, 6, 4.29, 4.28; 190/107, 115
See application file for complete search history.

(56) References Cited

U.S. PATENT DOCUMENTS

| | | | | |
|---|---|---|---|---|
| 2,600,501 | A * | 6/1952 | Higgs | A62B 31/00 600/22 |
| 2,913,029 | A * | 11/1959 | Hamilfon | B65D 90/046 220/9.2 |
| 3,114,453 | A * | 12/1963 | Rosenthal | B65D 15/22 229/162.4 |
| 8,167,157 | B2 * | 5/2012 | Shalomoff | B65D 11/1833 220/4.08 |
| 2013/0112686 | A1 | 5/2013 | Kwon | |
| 2014/0117072 | A1 | 5/2014 | Cullen et al. | |

FOREIGN PATENT DOCUMENTS

| | | | |
|---|---|---|---|
| JP | 11-59739 | A | 3/1999 |
| JP | 2000-33938 | A | 2/2000 |
| JP | 3119111 | | 1/2006 |
| JP | 2011-136717 | A | 7/2011 |
| JP | 5523818 | | 4/2014 |
| KR | 10-2012-0012189 | A | 2/2012 |

OTHER PUBLICATIONS

Extended Search Report for corresponding European Application No. 17759528.7 dated Sep. 23, 2019.
Office Action for Taiwanese Application No. 106104265 dated Nov. 20, 2019.

* cited by examiner

FOLDABLE TOTE BOX

TECHNICAL FIELD

The present invention relates to a foldable tote box. More specifically, the present invention relates to a foldable tote box that enables a content thereof to be visually checked.

BACKGROUND ART

Paper corrugated cardboard that has hitherto been used for transporting a product and the like is typically disposable, and hence a tote box made of plastic has been used. It is desired that the tote box be folded into a compact size after transporting a product and the like from the view point of transportation cost. However, in the case of the tote box made of plastic, components such as a hinge are required, and further downsizing is desired.

In view of the foregoing, the applicant of the present application has placed a foldable tote box described in Patent Literature 1 on the market. The foldable tote box can be easily folded. Moreover, the foldable tote box is strong against external impact and is excellent in stability at a time of stacking. Thus, the foldable tote box has achieved great popularity. Meanwhile, there is an increasing demand for a tote box that enables a content thereof to be checked under a state in which a lid is closed.

CITATION LIST

Patent Literature

Patent Literature 1: Japanese Patent No. 5523818

SUMMARY OF INVENTION

Technical Problem

The present invention has been made to meet the above-mentioned requirements, and it is an object of the present invention to provide a foldable tote box that enables a content thereof to be visually checked under a state in which a lid is closed.

Solution to Problem

A foldable tote box according to an embodiment of the present invention includes a box body. The box body includes: a square or rectangular bottom surface part; front and rear side wall parts and right and left side wall parts corresponding to respective sides of the bottom surface part; a lid extending from an upper edge of the rear side wall part; and a reinforcement plate configured to reinforce the bottom surface part. The reinforcement plate is pivotably mounted on a lower edge of the front side wall part or the rear side wall part. The right and left side wall parts are inwardly foldable when a center portion of the bottom surface part is pulled up. Each of the side wall parts is formed of a frame member configured to define an outline of the side wall part and maintain a shape of the side wall part, and a sheet material supported by the frame member. The sheet material includes a transparent portion, and the transparent portion enables a content of the foldable tote box to be visually checked.

In one embodiment of the present invention, the frame member is made of metal.

In one embodiment of the present invention, the transparent portion is formed of a resin sheet.

Advantageous Effects of Invention

According to the present invention, a foldable tote box includes a box body including: a square or rectangular bottom surface part; front and rear side wall parts and right and left side wall parts corresponding to respective sides of the bottom surface part; a lid extending from an upper edge of the rear side wall part; and a reinforcement plate configured to reinforce the bottom surface part. Each of the side wall parts is formed of a frame member configured to define an outline of the side wall part and maintain a shape of the side wall part, and a sheet material supported by the frame member. Through formation of a transparent portion in the sheet material, a content of the foldable tote box can be visually checked under a state in which the lid is closed.

DESCRIPTION OF EMBODIMENTS

Now, representative embodiments of the present invention are described with reference to the drawings, but the present invention is not limited to those embodiments.

Figure 1:
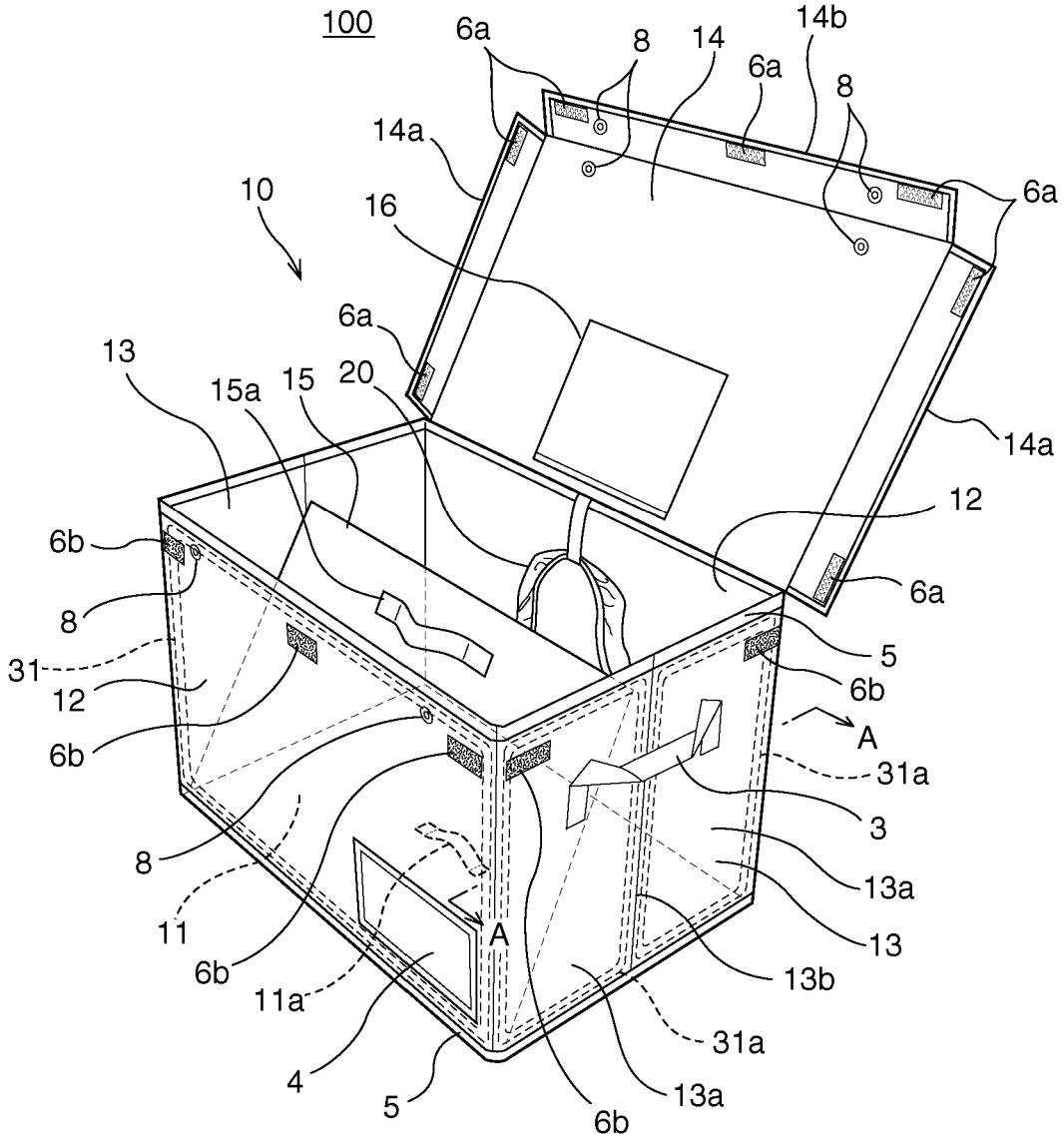
FIG. 1 is a perspective view of a foldable tote box according to one embodiment of the present invention when viewed from a front side.
Figure 2:
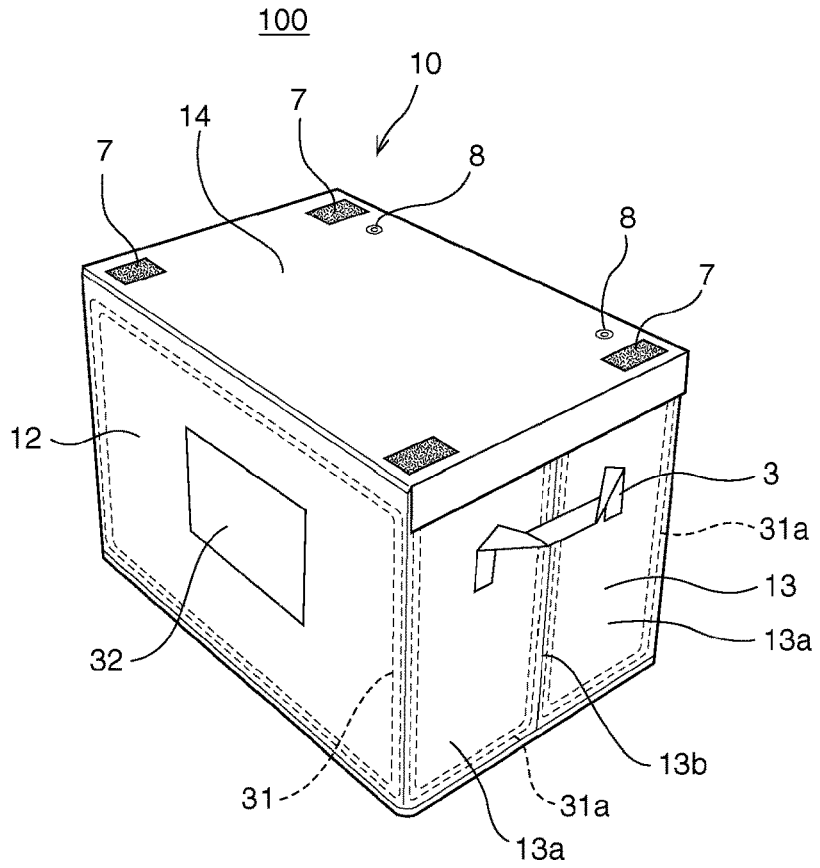
FIG. 2 is a perspective view of the foldable tote box of FIG. 1 under a state in which a lid is closed when viewed from a rear side.
Figure 3:
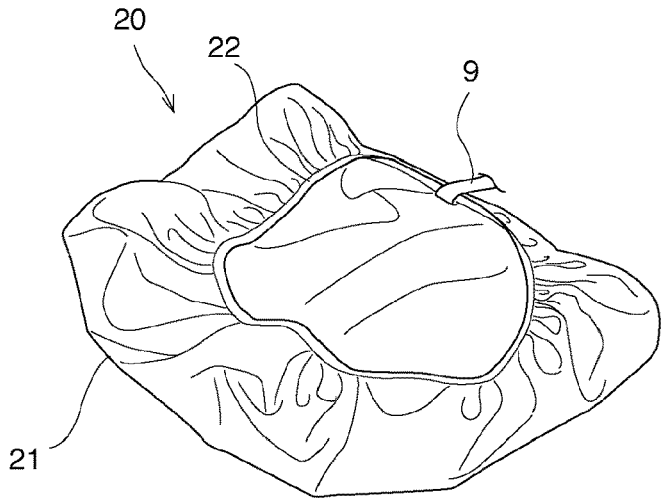
FIG. 3 is a view for illustrating a cover for the foldable tote box of FIG. 1.
Figure 4A:
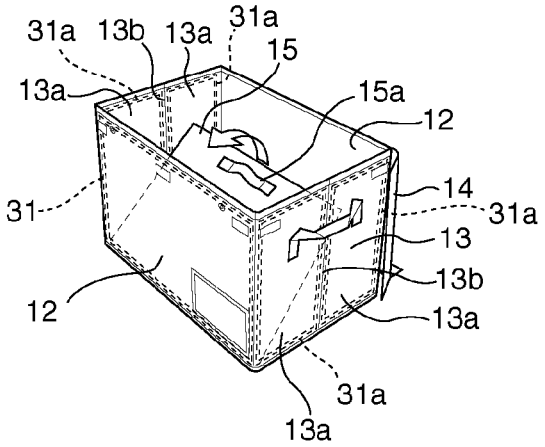
FIGS. 4(*a*) to 4(*d*) are each an explanatory view for illustrating a method of folding the foldable tote box of FIG. 1.
Figure 4B:
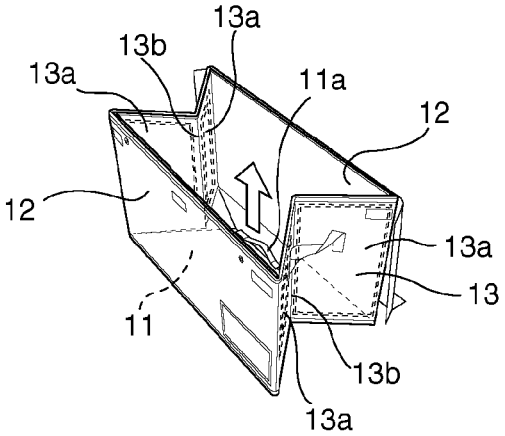
Figure 4C:
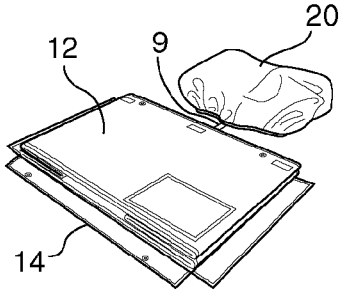
Figure 4D:
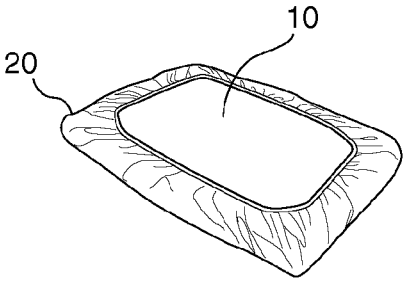

FIG. 1 is a perspective view of a foldable tote box according to one embodiment of the present invention when viewed from a front side. FIG. 2 is a perspective view of the foldable tote box under a state in which a lid is closed when viewed from a rear side. FIG. 3 is a view for illustrating a cover for the foldable tote box of FIG. 1. FIGS. 4(*a*) to 4(*d*) are each an explanatory view for illustrating a method of folding the foldable tote box of FIG. 1. A foldable tote box 100 includes a box body 10. As in the illustrated example, the foldable tote box 100 may further include, as needed, a cover 20 configured to cover the box body 10 under a state of being folded. The box body 10 includes a bottom surface part 11, front and rear side wall parts 12 and 12, right and left side wall parts 13 and 13, a lid 14, and a reinforcement plate 15 having a shape corresponding to the bottom surface part 11. A product and the like are accommodated in the box body 10 under a state in which the bottom surface part 11 is reinforced by the reinforcement plate 15. As used herein, "right", "left", "front", and "rear" describe the relative positional relationship of each part in the tote box, and "right" and "left", and "front" and "rear" may be interchangeably read.

The bottom surface part 11 has a square or rectangular shape. In the illustrated example, the bottom surface part 11 has a rectangular shape. The lid 14 has substantially the same shape as that of the bottom surface part 11. Thus, in the illustrated example, the lid 14 has a rectangular shape. The lid 14 extends from any one of upper edges of the front and rear side wall parts 12 and 12. The lid 14 is pivoted about the upper edge being a pivot axis, and an opening portion of the box body 10 can be opened or closed. The front and rear side wall parts 12 and 12 and the right and left side wall parts 13 and 13 each have a square or rectangular shape in conformity with each side of the bottom surface part 11.

The bottom surface part 11 is formed of a sheet material that can be deformed at a time of folding. The lid 14 and the reinforcement plate 15 are formed by enclosing a plate material in a sheet material. With this configuration, a content of the box body can be protected from external impact and can be stably transported. Further, when the plate material is formed so as to be enclosed in the sheet material, the box body becomes excellent in outer appearance, and the plate material can be satisfactorily recycled (subjected to material recycling or chemical recycling) without being contaminated or melted. Further, the plate material is prevented from having a flaw (for example, a seam) and hence can be easily reused.

As the sheet material, woven fabric or non-woven fabric is preferably used. This is because the sheet material can be subjected to material recycling as a combustion improver or the like. As fibers forming the woven fabric or the non-woven fabric, there are given, for example, polyester fibers. Further, as the sheet material, a polyolefin sheet made of polyethylene, polypropylene, or the like used as a leisure sheet, a vinyl chloride sheet, a nylon sheet, a polyurethane sheet, a biodegradable resin sheet, or the like used as an agricultural sheet is also preferably used. This is because those sheets are excellent in waterproofness, and an oil stain and the like can be wiped off from those sheets. The surface of the sheet material may be subjected to water-repellent treatment and antistatic treatment. As the plate material, any appropriate plate material is used in accordance with the weight of a product and the like to be accommodated in the box body. A plastic plate is preferably used, and a plastic corrugated cardboard plate is particularly preferably used. This is because those plastic plates are small in weight. When the content is large in weight, plywood, a flat plate, or the like is preferably used. Further, a material forming the box body 10 may have functions such as flame retardancy, incombustibility, waterproofness, moistureproofness, and heat insulating property (cold insulation).

In the embodiment of the present invention, the front and rear side wall parts 12 and 12 and the right and left side wall parts 13 and 13 (hereinafter sometimes simply referred to as "side wall parts") each include a frame member 31 and a sheet material supported by the frame member 31. Specifically, in each of the front and rear side wall parts 12 and 12, the frame member 31 is enclosed in the sheet material and is configured to define the outline of the sheet material (as a result, each of the front and rear side wall parts 12 and 12) and maintain the shape thereof. As illustrated in the drawings, the frame member has a frame shape in conformity with the outline of each of the front and rear side wall parts 12 and 12. In a conventional tote box, when an attempt is made to maintain the shape, strength, and the like of the tote box to a practically acceptable degree, it is required that a plate material be enclosed in a sheet material, and the plate material is formed of a substantially opaque material, with the result that it is substantially impossible to enable a content to be visually checked under a state in which a lid is closed. Meanwhile, according to the embodiment of the present invention, through adoption of the above-mentioned frame member and formation of a transparent portion in the sheet material, the content can be visually checked while the shape, strength, and the like of the tote box are maintained to the practically acceptable degree. As a result, operability and convenience in transportation of the product and the like can be significantly improved. As illustrated in FIG. 1 and FIG. 2, in the right and left side wall parts 13 and 13, two frame members 31*a* and 31*a* are enclosed in transparent sheets under a state of being laterally arrayed at a predetermined interval, and the transparent sheets are sewed between the two frame members 31*a* and 31*a*. Thus, each of the right and left side wall parts includes two divided portions 13*a* and 13*a* as illustrated in FIG. 1 and FIG. 2, and is foldable along a division line 13*b* between the two divided portions.

The frame member is made of any appropriate material that defines the outline of the side wall part and has strength capable of maintaining the shape thereof. A constituent material for the frame member may be appropriately selected in accordance with the weight, required strength, and the like. The thickness of each side of the frame may also be appropriately selected in accordance with the weight, required strength, and the like. The thickness of each side of the frame may be, for example, about 5 mm. With this thickness, the frame is excellent in balance between the strength and the weight (lightness). Each side of the frame may be formed of a hollow pipe or a solid bar. Four corners of the frame each representatively have a round shape. As representative examples of the constituent material for the frame member, there are given metal, plastic, ceramic, and wood. Metal is preferred. This is because metal is excellent in strength and is less liable to fracture or crack. As specific examples of metal, there are given iron, aluminum, and stainless steel. Iron is preferred.

The sheet material is as described above regarding the lid 14 and the reinforcement plate 15.

As described above, the sheet material includes a transparent portion 32. It is only required that the transparent portion 32 have transparency to such a degree that the content can be visually checked under a state in which the lid is closed. The transparent portion is representatively formed of a resin sheet. As specific examples of a resin forming the resin sheet, there are given a vinyl chloride-based resin, an acrylic resin, a polyester-based resin, a polyolefin-based resin, and a polystyrene-based resin. The vinyl chloride resin is preferred. The transparent portion can be formed by punching out a predetermined position of the sheet material and sewing the resin sheet to the punched out position. The transparent portion (resin sheet) has a thickness of, for example, about 0.5 mm. When the thickness falls within this range, the practically acceptable strength can be realized while maintaining the visibility of the content. In one embodiment, the transparent portion is embossed. Through embossing, the strength of the transparent portion can be increased.

The area (size), installation number, installation position, and the like of the transparent portion may be appropriately set in consideration of the balance between the visibility securement of the content and the strength of the tote box. In the illustrated example, the transparent portion 32 is formed in a center portion of the rear side wall part 12.

Figure 6:
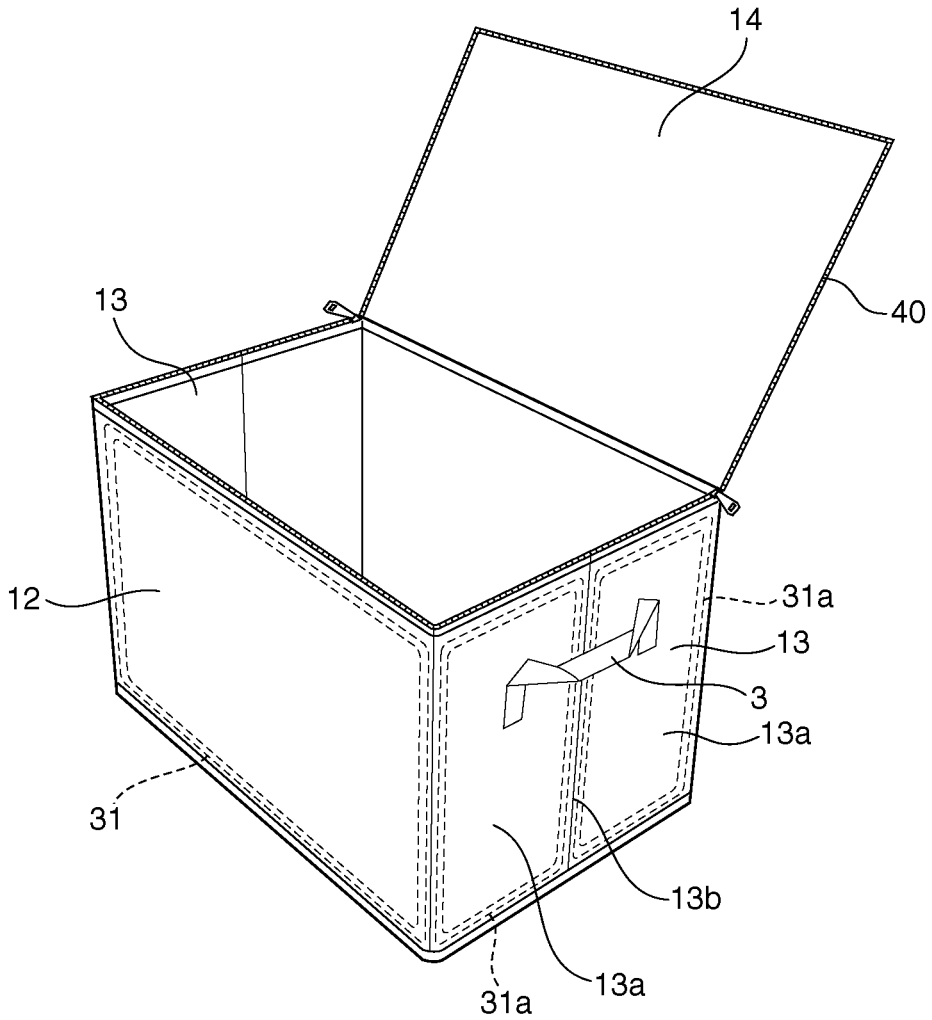
FIG. 6 is a perspective view of a foldable tote box according to still another embodiment of the present invention when viewed from a front side.

In one embodiment, at least one of the front and rear side wall parts 12 and 12 and the right and left side wall parts 13 and 13 may be formed of the resin sheet constituting the transparent portion 32, and at least one of the side wall parts may be made transparent in a substantially entire surface. With this configuration, the visibility of the content can be further improved. Such a configuration is enabled for the first time through use of the above-mentioned frame member. FIG. 6 is a view for illustrating an embodiment in which the entire surface of each of the front and rear side wall parts 12 and 12 and the right and left side wall parts 13 and 13 is transparent.

In the side wall parts 12 and 12 and the side wall parts 13 and 13, the sheet materials are sewed to each other at each connection position.

A band-shaped handle 3 is provided to an outer side of each of the right and left side wall parts 13 and 13. The handle 3 has both ends thereof sewed to the sheet material so as to stride across the division line 13*b*. The front and rear side wall parts 12 and 12 and the right and left side wall parts 13 and 13, and/or the lid 14 may have a transparent pocket 4. In the illustrated example, the transparent pocket 4 is formed in a lower right portion of the front side wall part. The size, installation number, installation position, and the like of the transparent pocket 4 may be appropriately set in accordance with the purpose. The transparent pocket 4 is used for putting a voucher or bonding a seal, and can also be used for the purpose of traceability. The transparent pocket may be formed, for example, by sewing three sides of a rectangular resin sheet to the sheet material.

As described above, the bottom surface part 11 is formed of one sheet material, and a peripheral edge thereof is rimmed with a trimming tape 5. The sheet material of the bottom surface part and the side wall parts are sewed to each other through intermediation of the trimming tape 5. An upper end of each side wall part is also rimmed with the trimming tape 5.

A handgrip 11*a* may be provided to a center portion of the bottom surface part 11. When the deformable bottom surface part 11 is pulled up with the handgrip 11*a*, the right and left side wall parts 13 and 13 which are formed continuously from the bottom surface part 11 are folded inwardly so that the divided portions 13*a* and 13*a* overlap with each other, with the result that the box body 10 is folded. Thus, the box body 10 can be easily folded, and work ability is improved. Further, the box body 10 is folded by pulling up the bottom surface part 11, and hence the bottom surface part 11 does not extend out of the front and rear side wall parts 12 in a folded state, with the result that the box body 10 can be folded into a compact size.

The reinforcement plate 15 is pivotably mounted on any one of lower edges of the front and rear side wall parts 12 and 12, and as illustrated in FIGS. 4(*a*) and 4(*b*), the box body 10 is folded with the reinforcement plate 15 overlapping with the front side wall part 12. A handgrip 15*a* is provided to an upper surface of the reinforcement plate 15, and the reinforcement plate 15 is pivoted with the handgrip 15*a*. The reinforcement plate 15 (bottom surface part 11) is designed so as to have substantially the same shape as those of the front and rear side wall parts 12 or so as to be smaller than the front and rear side wall parts 12 and is accommodated in the box body 10 at a time of folding. An end portion of the sheet material of the reinforcement plate 15 is sewed to the sheet material forming the front side wall part 12 and/or the sheet material of the bottom surface part 11.

Figure 5:
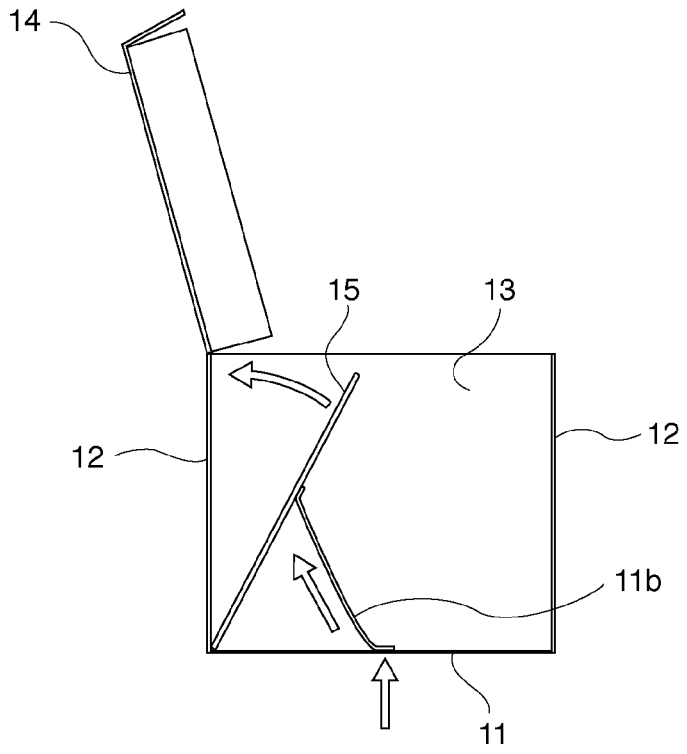
FIG. 5 is a longitudinal sectional view of a foldable tote box according to another embodiment of the present invention.

In another embodiment, as illustrated in FIG. 5, a coupling member 11*b* configured to couple the center portion of the bottom surface part 11 and the reinforcement plate 15 to each other is provided. The coupling member 11*b* is configured to couple a lower surface center portion of the reinforcement plate 15 and the center portion of the bottom surface part 11 to each other. In this embodiment, when the reinforcement plate 15 is pivoted upwardly, the bottom surface part 11 is simultaneously pulled up, and the right and left side wall parts 13 and 13 are folded inwardly. Thus, the box body 10 is folded through one-touch operation, and the workability is further improved. Further, under a state in which the box body 10 is folded, the bottom surface part 11 is pulled by the reinforcement plate 15 and does not extend out of the front and rear side wall parts 12. Therefore, the box body can be reliably folded into a compact size. The coupling member 11*b* is formed of, for example, a belt made of polypropylene, a rubber band or the like, and both ends thereof are sewed to the bottom surface part 11 and the reinforcement plate 15. The coupling member 11*b* may be replaceably provided, for example, through use of a hook-and-loop fastener. When the coupling member is degraded (for example, when the rubber is fully stretched), the coupling member can be replaced by a new coupling member.

Extending portions 14*a*, 14*b*, and 14*a* extending from three end sides of the lid 14 are foldably formed and are each formed of a band-shaped sheet material. Hook-and-loop fasteners 6*a* are sewed to inner surfaces of the extending portions 14*a*, 14*b*, and 14*a*. Hook-and-loop fasteners 6*b* corresponding to the hook-and-loop fasteners 6*a* are sewed to upper end portions of the side wall parts. In the illustrated example, as fastening means between the lid and the side wall parts, the extending portions are formed, and the hook-and-loop fasteners are adopted. However, the present invention is not limited thereto, and, for example, snaps, hooks, fasteners, or the like are used. Thus, when the fastening means is provided, a sealing property becomes excellent, and dust, water, and the like can be prevented from entering the box body.

Hook-and-loop fasteners 7 are sewed to an upper surface of the lid 14. Hook-and-loop fasteners (not shown) corresponding to the hook-and-loop fasteners 7 are sewed to a lower surface of the bottom surface part 11. When the box bodies 10 are stacked, the box bodies can be fixed to each other, with the result that load shifting can be reliably prevented.

Pinholes 8 are formed in a front end portion of the lid 14, an upper end portion of the front side wall part 12, and the extending portion 14*b* formed at a front edge of the lid 14. The pinholes 8 have, for example, padlocks or pins inserted therein and are used for preventing theft.

In still another embodiment, as illustrated in FIG. 6, the lid 14 may be formed so as to be capable of being opened or closed with a fastener 40.

In order to prevent the cover 20 from being lost, the cover 20 is provided to an opening portion (upper end of the side wall part) of the box body 10 so as not to be removed from the box body 10. In the illustrated example, the cover 20 is provided to an upper edge center portion of the rear side wall part 13 through intermediation of a wide rubber 9. As illustrated in FIG. 3, the cover 20 includes a cap portion 21 formed of a sheet material and a gathered portion 22 formed around an opening of the cap portion 21. The gathered portion 22 is formed of a rubber string that is stretchably sewed to the opening of the cap portion 21. As illustrated in FIGS. 4(*c*) and 4(*d*), the cover 20 does not always needs to cover the entire box body 10 under a state of being folded. The box body 10 includes an accommodating portion 16 configured to accommodate the cover 20. In the illustrated example, the accommodating portion 16 is formed on an inner surface of the lid 14.

In still another embodiment, a binding belt (not shown) may be used in place of the cover. The binding belt may be provided, for example, by sewing an elastic band-shaped belt to an appropriate position on the accommodating portion side of the lid 14. With this configuration, the accommodating portion side of the lid 14 is positioned outside at a time of folding the tote box as illustrated in FIG. 4(*c*), and hence the folded tote box can be bound by folding back the elastic band-shaped belt. Thus, the elastic band-shaped belt may be provided at a position of being capable of being folded back to bind the tote box on the accommodating portion side of the lid 14. More specifically, the elastic band-shaped belt may be provided at a position of the lid 14 of being placed in the vicinity of the upper edge or the lower edge of the side wall part when the tote box is folded.

Although not shown, a pocket capable of accommodating a packing note or the like may be formed on an inner surface of the box body. Further, when food and the like are transported, a pocket for a cooling storage agent or a cold reserving material may be preferably formed on the inner surface of the box body.

In transportation of the product and the like, the product and the like are accommodated in the box body 10, and the opening portion of the box body 10 is closed with the lid 14. Then, the hook-and-loop fasteners 6*a* of the extending portions 14*a* and 14*b* of the lid are fastened to the hook-and-loop fasteners 6*b* of the side wall parts. The box body 10 accommodating the product and the like are conveyed, for example, by lifting up the box body 10 through use of the handles 3 and 3. Reinforcement means may be provided on a lower surface or edges of the bottom surface part 11 so that the bottom surface part 11 is not broken even when the box body 10 is conveyed by being dragged when the content of the box body 10 is a heavy object.

After transportation, as illustrated in FIG. 4(*a*), the lid 14 of the box body 10 which is emptied is pivoted rearwardly to overlap with the rear side wall part 12. Further, as illustrated in FIG. 4(*b*), the reinforcement plate 15 is pivoted upwardly to overlap with the front side wall part 12. Next, the handgrip 11*a* of the bottom surface part 11 is pulled up to bend the right and left side wall parts 13 and 13 inwardly, to thereby fold the box body 10. Then, as illustrated in FIGS. 4(*c*) and 4(*d*), the folded box body 10 is covered with the cover 20. Through use of the cover 20, the box body 10 can be prevented from being contaminated. Further, the right and left side wall parts 13 and 13 do not expand, and the lid 14 is held so as not to be pivoted, which may contribute to downsizing. Thus, the box body 10 can be folded into a compact size with remarkably simple operation, and hence transportation efficiency is improved.

The foldable tote box of the present invention is not limited to the configurations of the above-mentioned embodiments and can be appropriately modified. For example, the positions of the cover, the accommodating portion of the cover, the handles, the pockets, the pinholes, and the like can be appropriately changed. The number of the handles, the pockets, the pinholes, and the like can be appropriately changed.

INDUSTRIAL APPLICABILITY

The foldable tote box of the present invention is suitably used for transporting a product and the like.

REFERENCE SIGNS LIST

10 box body
11 bottom surface part
12 front and rear side wall part
13 right and left side wall part
14 lid
15 reinforcement plate
16 accommodating portion
31 frame member
32 transparent portion
100 foldable tote box.

The invention claimed is:

1. A foldable tote box, comprising a box body, the box body including:

a square or rectangular bottom surface part;

front and rear side wall parts and right and left side wall parts corresponding to respective sides of the bottom surface part;

a lid extending from an upper edge of the rear side wall part; and a reinforcement plate configured to reinforce the bottom surface part, wherein the reinforcement plate is pivotably mounted on a lower edge of the front side wall part or the rear side wall part, wherein the right and left side wall parts are inwardly foldable when a center portion of the bottom surface part is pulled up, wherein each of the side wall parts is formed of a frame member configured to define an outline of the side wall part and maintain a shape of the side wall part, and a sheet material supported by the frame member, and wherein the sheet material includes a transparent portion, and the transparent portion enables a content of the foldable tote box to be visually checked, in the front side wall part, the frame member has a frame shape in conformity with the outline of the front side wall part, in the rear side wall part, the frame member has a frame shape in conformity with the outline of the rear side wall part, and each of the right and left side wall parts comprises two frame member portions enclosed in transparent sheets under a state of being laterally arrayed at a predetermined interval, wherein the transparent sheets are sewed between the two frame member portions, and wherein each of the right and left side wall parts is inwardly foldable between the two frame member portions.

2. The foldable tote box according to claim 1, wherein the frame member is made of metal.

3. The foldable tote box according to claim 1, wherein the transparent portion is formed of a resin sheet.

4. The foldable tote box according to claim 2, wherein the transparent portion is formed of a resin sheet.

* * * * *